United States Patent [19]

Gagnon

[11] Patent Number: 4,976,249

[45] Date of Patent: Dec. 11, 1990

[54] TARGET LAUNCHING TRAP

[76] Inventor: Kenneth M. Gagnon, 4 Mill St., Cumberland, R.I. 02864

[21] Appl. No.: 371,291

[22] Filed: Jun. 26, 1989

[51] Int. Cl.[5] ..... F41B 3/04

[52] U.S. Cl. ..... 124/8; 124/36

[58] Field of Search ..... 124/8, 6, 7, 43, 36, 124/40, 42, 9

[56] References Cited

U.S. PATENT DOCUMENTS

| | | | |
|---|---|---|---|
| 948,499 | 2/1910 | Clow | 124/8 |
| 993,501 | 5/1911 | Bowers | 124/36 X |
| 1,771,865 | 7/1930 | Spangler | 124/36 X |
| 2,430,077 | 11/1947 | Razee | 124/36 X |
| 2,455,661 | 12/1948 | DuPont | 124/8 |
| 2,504,437 | 4/1950 | McEwen | 124/8 |
| 4,363,311 | 12/1982 | Rodney | 124/36 X |

FOREIGN PATENT DOCUMENTS

| | | | |
|---|---|---|---|
| 1403490 | 5/1965 | France | 124/8 |

*Primary Examiner*—Peter M. Cuomo

*Attorney, Agent, or Firm*—Barlow & Barlow, Ltd.

[57] ABSTRACT

A clay pigeon target launching device has a launching arm supported on a pivot shaft that is received in a unidirectional bearing housing. The launching arm is biased into a tensioned position and held in that position by a pair of levers that are pivoted and which engage a stop abutment that is coupled to the shaft of the launching arm. The arrangement is such that both levers must be released before the launching arm can rotate which keeps both hands out of the path of the launching arm as a safety feature.

4 Claims, 1 Drawing Sheet

TARGET LAUNCHING TRAP

BACKGROUND OF THE INVENTION

This invention relates to a target launching trap and more particularly, to an improvement in the trap mechanism as it is used in skeet shooting. The usual type of device for launching clay pigeons has a swing arm upon which the pigeon is supported and the arm is generally tensioned by a spring that acts on the arm and a retractable trigger is generally provided so that the arm may be retained in what is called "cocked" position. When the trigger is retracted, the arm is released and swings under influence of the spring to launch the clay pigeon. In most of the prior art where spring loaded launchers are seen, the cocking of the launching arm is carried out by physically moving the swing arm so as to tension the spring and bring the arm into engagement with a stop. The stop is usually in the form of a releasable trigger as noted above and in most of the prior art devices, the releasing member is physically located in close adjacency to the throwing arm. It is important, therefore, that the operator have not only his body but his arms out of the way of the throwing arm to avoid injury. In the prior art such as U.S. Pat. Nos. 2,980,095 and 3,949,728 all of the traps that release with hand action, use only one hand for release, thus leaving one hand and arm free. From a safety standpoint, it is preferable to have both hands engaged in a fixed position before the arm is released to avoid injury. The only protective arrangement known is a screen covering the arm as seen in U.S. Pat. No. 762,353.

SUMMARY OF THE INVENTION

A clay pigeon target launching device has a swing arm upon which a clay pigeon is supported. The arm is supported on a pivot shaft which is coupled to a unidirectional clutch that provides rotation in only one direction. A spring acts upon the arm through a crank lever The arm can be moved in one direction into a cocked position in which a biasing spring acting upon the arm is tensioned, the arm being retained in cocked position by a pair of rockable levers that are pivotally mounted to engage a stop boss on a crank lever attached to the pivotal shaft of the arm. When both rockable levers are retracted from the stop boss, the arm will be released and it will swing under the influence of its biasing spring to launch the clay pigeon.

It is the primary object of the invention to provide an improved means for latching the throwing arm of a target trap which will be convenient to operate and which will require the utilization of two hands of the operator.

DESCRIPTION OF THE PREFERRED EMBODIMENT

Figure 2:
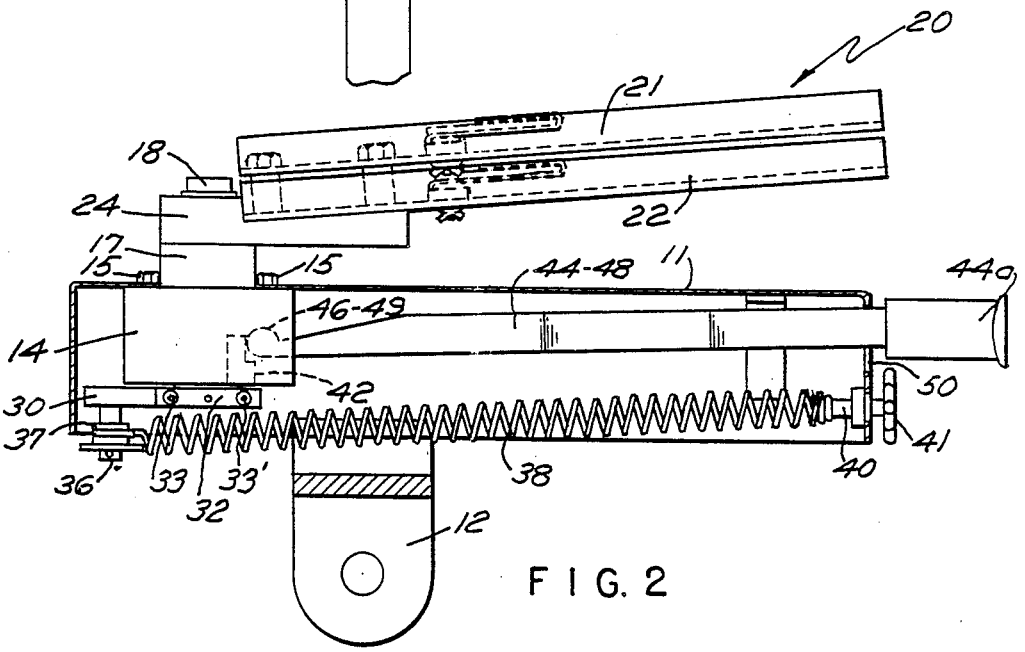
FIG. 2 is a cross sectional, side elevation view of the apparatus of FIG. 1.

With reference to the drawing, a target launching trap comprises a base 10 in the form of a box having an open bottom and is adapted for mounting as, for example, by a mounting ear 12 to any suitable support such as a post 13. It will be apparent that the housing 10 may be locked in any desired position such as the upwardly angled position illustrated which will define the trajectory of the clay pigeons The housing 10 provides a support for a unidirectional bearing 14 which is secured to the top wall 11 of the housing by a plurality of fasteners such as 15 and the bearing housing has an upper extension 17 that protrudes above the upper wall 11. A shaft 18 is supported in the bearing 14 and the upper end of the shaft 18 has clamped thereto the throwing arm 20. As seen in FIG. 2, the throwing arm 20 consists of a pair of plates 21, 22 which will support clay pigeons and these plates in turn are fastened to a clamping arm 24 that is affixed to the shaft 18 by any suitable means.

Figure 1:
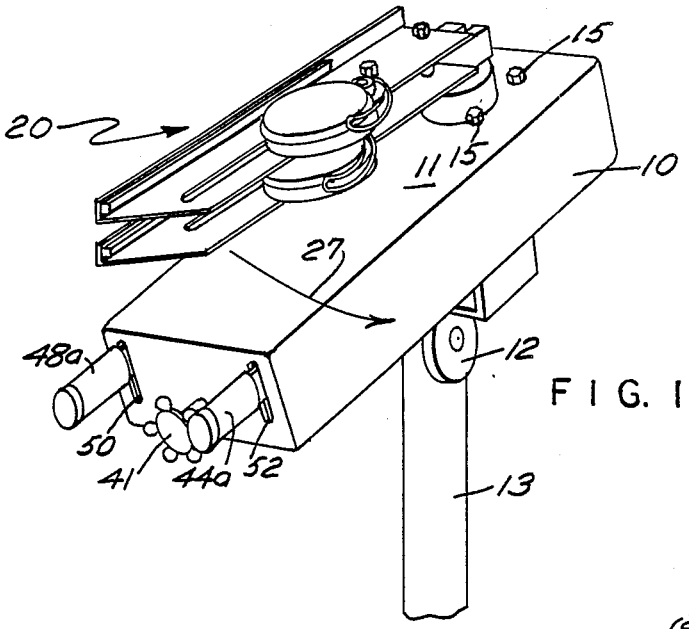
FIG. 1 is a perspective view of the target launching trap.
Figure 3:
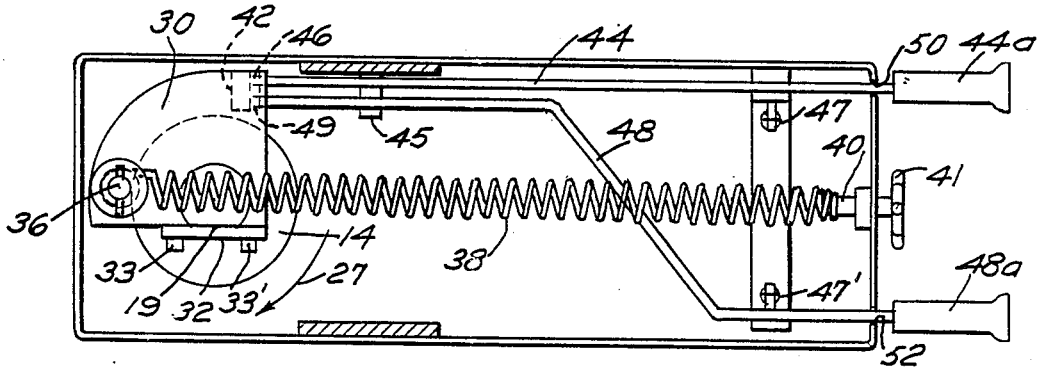
FIG. 3 is a bottom plan view.

The unidirectional bearing 14 of any suitable proprietary type is imposed between the shaft 18 and the housing 10 so as to permit rotation of the shaft 18 in one direction only; namely, the direction shown by the arrow 27 in FIGS. 1 and 3. The lower end of the shaft 18 projects below the unidirectional bearing 14 and carries a crank plate or crank lever 30 which is formed, as illustrated, as a sector. It will be noted that the shaft 18 at its lower end is milled with a flat 19 so that the crank plate 30 may be readily clamped for positive rotation with the shaft by simple means of a clamping plate 32 that is secured by a pair of bolts 33, 33'.

The crank plate has an anchor 36 in the form of a post secured thereto and a rotational sleeve 37 thereon, which serve as a swivel anchorage for one end of a tensioning spring 38. The other end of the tensioning spring 38 is anchored relative to the housing by an adjusting screw 40 that may vary the tension of the spring and which is provided with a convenient handle 41 that projects outside of the housing 10. The crank plate 30 is provided with a stop boss 42. As seen in FIG. 2, the stop boss, or abutment 42, is in a position radially outward of the unidirectional bearing housing 14. To engage the abutment, there is provided a first lever 44 which is mounted on a pivoting stud 45 and which has a nose portion at 46 that engages the stop abutment, the lever being biased in an up position by a spring 47. In addition, a second lever 48 has a nose portion 49 that engages the stop abutment and is likewise pivoted on the stud 45 and extends out of the housing being biased in an upwardly position by a spring 47'. At the ends of each of the levers 44 and 48 are handles **44*a*, 48*a* and, as seen in FIG. 2, these levers are adapted to reciprocate through slots 50 and 52**.

The clay pigeon target launching device can be cocked by simply rotating the arm 20 in a counterclockwise direction as viewed in FIG. 1 and this will tension the spring 38, the arm being rotated until the abutment ends of the levers engage the stop abutment 42. At this point, the anchor for the crank lever plate 30 will be slightly off center so that upon release of the levers, the launching arm will swing rapidly in a counterclockwise direction as viewed in FIG. 1. The clay target moves outwardly along the arm 21 or 22, as the case might be, so that a spinning motion is imparted to the clay pigeon target before it is launched from the arm 20 in a generally tangential direction.

I claim:

1. A clay pigeon target launching device comprising a housing, an arm, said arm having means to releasably grip a clay pigeon, a pivot shaft supporting said arm, a unidirectional bearing secured to said housing, said shaft supported in said bearing, a crank lever attached to said shaft and having an anchor and a stop abutment, a spring connected to the anchor and to the housing, a pair of rockable levers each pivotally mounted on the housing to rock in and out of engagement with the stop abutment wherein the spring acts upon the crank lever to urge the stop abutment against the levers and both levers must be rocked to release the arm.

2. A device as in claim 1 wherein the crank lever is a sector plate and the anchor and stop abutment are located within a right angle of each other.

3. A device as in claim 1 wherein the levers are pivoted to a wall of the housing on a common pivot and pass through another wall normal thereto to protrude therefrom.

4. A device as in claim 3 wherein the levers are biased in a common direction to permit engagement with the stop abutment.

* * * * *